US009133742B2

(12) United States Patent
Hwang et al.

(10) Patent No.: US 9,133,742 B2
(45) Date of Patent: Sep. 15, 2015

(54) OIL FILTER SYSTEM FOR VEHICLE

(71) Applicant: Hyundai Motor Company, Seoul (KR)

(72) Inventors: Yun Sung Hwang, Whasung-Si (KR); Kyu Sup Kim, Whasung-Si (KR); Won Joo Roh, Whasung-Si (KR); Bong Whoa Jeong, Whasung-Si (KR)

(73) Assignee: HYUNDAI MOTOR COMPANY, Seoul (KR)

( * ) Notice: Subject to any disclaimer, the term of this patent is extended or adjusted under 35 U.S.C. 154(b) by 0 days.

(21) Appl. No.: 14/099,765

(22) Filed: Dec. 6, 2013

(65) Prior Publication Data

US 2014/0182568 A1 Jul. 3, 2014

(30) Foreign Application Priority Data

Dec. 27, 2012 (KR) ..... 10-2012-0155370

(51) Int. Cl.
*F01M 13/04* (2006.01)

(52) U.S. Cl.
CPC ..... *F01M 13/04* (2013.01)

(58) Field of Classification Search
CPC ..... F01M 13/04; F01M 13/022; F02M 25/06
USPC ..... 123/572–574
See application file for complete search history.

(56) References Cited

U.S. PATENT DOCUMENTS 3,677,240 A * 7/1972 Sarto ..... 123/572
4,156,406 A * 5/1979 Brandau et al. ..... 123/41.86
4,602,595 A * 7/1986 Aoki et al. ..... 123/41.86
4,603,673 A * 8/1986 Hiraoka et al. ..... 123/573
7,165,541 B2 1/2007 Hommes
8,794,221 B2 * 8/2014 Kobayashi et al. ..... 123/572
2005/0092267 A1 * 5/2005 Nonaka et al. ..... 123/41.86
2010/0006075 A1 * 1/2010 Ruppel et al. ..... 123/573
2011/0088650 A1 * 4/2011 Mavinahally et al. .... 123/195 R
2013/0125865 A1 * 5/2013 Kobayashi et al. ..... 123/573
2013/0276767 A1 * 10/2013 Polichetti et al. ..... 123/573
2014/0048052 A1 * 2/2014 Subedi et al. ..... 123/572
2014/0182569 A1 * 7/2014 Hwang et al. ..... 123/572

FOREIGN PATENT DOCUMENTS

JP 5-83310 U 11/1993
KR 2002-0045619 A 6/2002

* cited by examiner

*Primary Examiner* — Marguerite McMahon

(74) *Attorney, Agent, or Firm* — Morgan, Lewis & Bockius LLP

(57) ABSTRACT

An oil filter system for a vehicle may provided at a cylinder block of an engine for collecting engine oil from a blow-by gas generated in a crank case. The oil filter system may include a blow-by path to recirculate the blow-by gas so that the blow-by gas generated in the crank case is combusted together with a fuel-air mixture, a filter case that is a space formed between the crank case and the blow-by path, a filter partition disposed to divide the filter case into two spaces, and configured to collect the engine oil contained in the blow-by gas, and an oil pan mounted in the cylinder block for collecting the engine oil that have been collected by the filter partition. The filter partition may collect the engine oil in a forward direction flow and a reverse direction flow of the blow-by gas.

6 Claims, 3 Drawing Sheets

OIL FILTER SYSTEM FOR VEHICLE

CROSS-REFERENCE TO RELATED APPLICATION

The present application claims priority of Korean Patent Application Number 10-2012-0155370 filed Dec. 27, 2012, the entire contents of which application are incorporated herein for all purposes by this reference.

BACKGROUND OF INVENTION

1. Field of Invention

The present invention relates to an oil filter system for a vehicle, and more particularly, to an oil filter system for a vehicle for collecting engine oil by using fluidity of blow-by gas.

2. Description of Related Art

In general, an internal combustion engine is a device for generating power by receiving air and fuel inside the engine and combusting the air and the fuel. When the internal combustion engine is operated, blow-by gas is generated in a compression stroke and an expansion stroke. Particularly, the blow-by gas is mostly generated in the compression stroke, and is partially generated in the expansion stroke.

The blow-by gas is gas discharged to a crank case through a gap between a cylinder and a piston in the compression stroke and the expansion stroke of the engine. The blow-by gas degrades engine oil which may cause rusting an internal side of the engine. Further, an internal side of a cylinder block is under high pressure by the blow-by gas. Accordingly, when the blow-by gas flowing into the cylinder block is not smoothly circulated, a malfunction is generated in driving the engine, so that the engine may be stopped or cause an explosion.

In order to prevent the aforementioned problem, a method of rapidly discharging the blow-by gas to the outside is used in the related art, but a method of resending the blow-by gas to a suction system has been recently used in order to prevent air pollution. That is, a method of supplying the blow-by gas to a combustion chamber and re-combusting the blow-by gas has been used. A device for re-combusting the blow-by gas by circulating the blow-by gas generated during an operation of the engine to the combustion chamber to prevent the blow-by gas from being leaked to the outside of the crank case is referred to as a crank case ventilation system.

The crank case ventilation system has been widely applied to a head cover covering the cylinder of the engine. In the general crank case ventilation system in the related art, the blow-by gas is primarily supplied from the crank case to the cylinder head through a through-path formed between the crank case and the cylinder head. Further, the blow-by gas supplied to the cylinder head is supplied to an intake manifold, and is supplied to the combustion chamber through an intake port.

As described above, the blow-by gas is collected at an intake device of the engine. Here, a filter device may be included in order to remove fine engine oil contained in the blow-by gas. The engine oil collected at the filter device is collected at an oil pan included in a lower portion of the engine through a collection pipe.

The fine engine oil contained in the blow-by gas is collected at the filter device by a flow of the blow-by gas according to a change in pressure inside the crank case. Particularly, two pistons simultaneously move up and down in a two cylinder engine, so that a change in pressure inside the crank case may become severe.

When the pressure inside the crank case is increased, the blow-by gas may move from the inside of the crank case to the outside, and when the pressure inside the crank case is decreased, the blow-by gas may move from the outside of the crank case to the inside of the crank case. Accordingly, an engine oil filter system actively using fluidity of the blow-by gas is demanded.

In the meantime, when the blow-by gas containing the fine engine oil is supplied to the combustion chamber, a quantity of carbon generated during the combustion of fuel-air mixture is increased, and durability and combustion efficiency of the engine may be degraded.

The information disclosed in this Background section is only for enhancement of understanding of the general background of the invention and should not be taken as an acknowledgement or any form of suggestion that this information forms the prior art already known to a person skilled in the art.

SUMMARY OF INVENTION

The present invention has been made in an effort to provide an oil filter system for a vehicle for collecting engine oil by using both of bidirectional flows of blow-by gas. Further, the present invention has been made in an effort to provide an oil filter system for a vehicle for decreasing the consumption of engine oil and simultaneously improving performance of an engine.

Various aspects of the present invention provides an oil filter system for a vehicle that can be provided at a cylinder block of an engine for collecting an engine oil from a blow-by gas generated in a crank case. The oil filter system may include a blow-by path configured to recirculate the blow-by gas so that the blow-by gas generated in the crank case is combusted together with a fuel-air mixture, a filter case that is a space formed between the crank case and the blow-by path, a filter partition disposed to divide the filter case into two spaces, and configured to collect the engine oil contained in the blow-by gas, and an oil pan mounted in the cylinder block for collecting the engine oil that have been collected by the filter partition. The filter partition may be formed to collect the engine oil in a forward direction flow and a reverse direction flow of the blow-by gas.

The oil filter system may further include a forward baffle plate that spatially separates the crank case from the filter case and a reverse baffle plate that spatially separates the filter case from the blow-by path. The forward baffle plate and the reverse baffle plate may be formed with pores through which the blow-by gas passes.

The filter partition may include a filter pore comprising a plurality of pores through which the blow-by gas passes, and a counterflow prevention hump protruding along a circumference of the filter pore, wherein the blow-by gas passing through the pores of the forward baffle plate is in contact with one surface of the filter partition, the blow-by gas passing through the pores of the reverse baffle plate is in contact with the other surface of the filter partition, and the filter partition collects the engine oil when the blow-by gas is in contact with the filter partition.

The engine oil collected at the filter partition may be dropped by weight, and may be collected at the oil pan through an oil collection port. The oil collection port may include a forward oil collection port facilitating collection of the engine oil that has been collected in the one surface of the filter partition, and a reverse oil collection port facilitating collection of the engine oil that has been collected in the other surface of the filter partition.

The counterflow prevention hump may be formed to prevent a counterflow of the blow-by gas passing through the filter pore when the blow-by gas is the forward direction flow and/or the reverse direction flow. The forward baffle plate and the reverse baffle plate may be integrally formed with the cylinder block. The cylinder block may be formed such that a space in which the oil pan is mounted, the crank case, the filter case, and the blow-by path are spatially separated from each other.

The methods and apparatuses of the present invention have other features and advantages which will be apparent from or are set forth in more detail in the accompanying drawings, which are incorporated herein, and the following Detailed Description, which together serve to explain certain principles of the present invention.

DETAILED DESCRIPTION

Reference will now be made in detail to various embodiments of the present invention(s), examples of which are illustrated in the accompanying drawings and described below. While the invention(s) will be described in conjunction with exemplary embodiments, it will be understood that present description is not intended to limit the invention(s) to those exemplary embodiments. On the contrary, the invention(s) is/are intended to cover not only the exemplary embodiments, but also various alternatives, modifications, equivalents and other embodiments, which may be included within the spirit and scope of the invention as defined by the appended claims.

Figure 1:
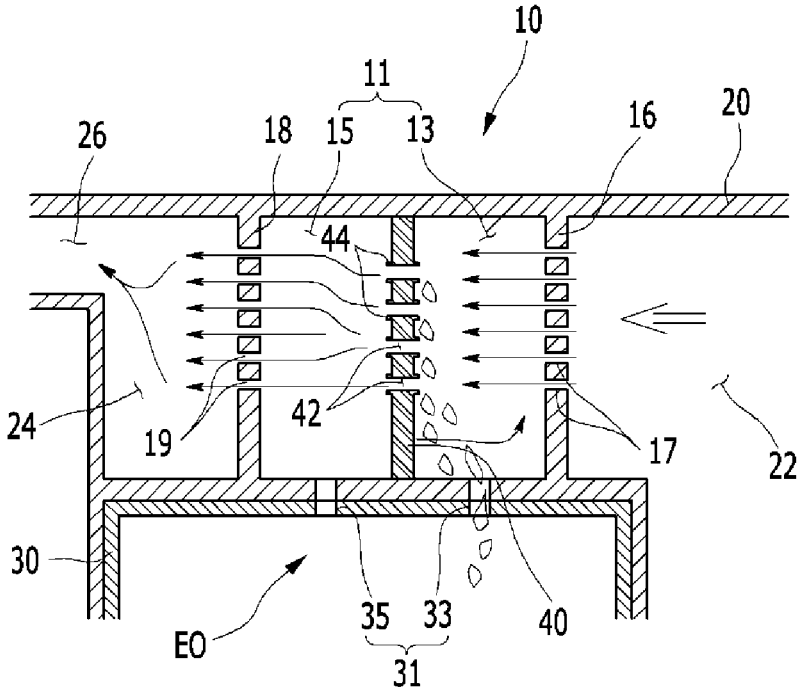
FIG. 1 is a configuration diagram of an exemplary oil filter system for a vehicle illustrating a forward direction flow of blow-by gas according to the present invention.
Figure 2:
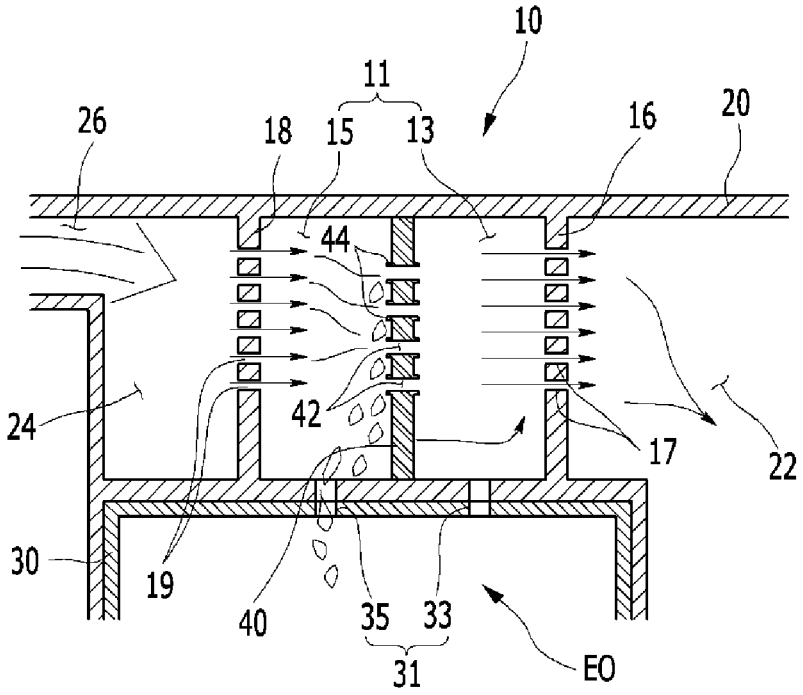
FIG. 2 is a configuration diagram of an exemplary oil filter system for a vehicle illustrating a reverse direction flow of blow-by gas according to the present invention.
Figure 3:
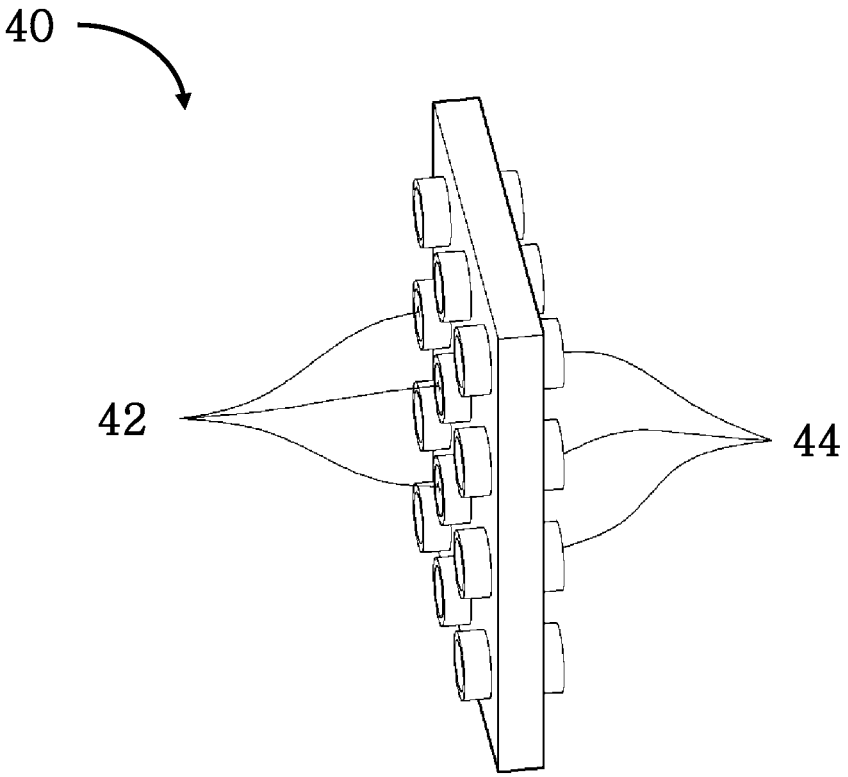
FIG. 3 is a perspective view of an exemplary filter partition according to the present invention.

FIG. 1 is a configuration diagram of an oil filter system for a vehicle illustrating a forward direction flow of blow-by gas, FIG. 2 is a configuration diagram of the oil filter system for the vehicle illustrating a reverse direction flow of blow-by gas, and FIG. 3 is a perspective view of a filter partition according to various embodiments of the present invention.

Here, a forward direction flow of the blow-by gas is defined as a flow by which the blow-by gas is discharged from the crank case 22 when pressure of the crank case 22 is high. Further, a reverse direction flow of the blow-by gas is defined as a flow by which the blow-by gas flows into the crank case 22 when pressure of the crank case 22 is low. Particularly, since two pistons simultaneously move up and down in a two cylinder engine, a change in pressure of the crank case 22 is severe, so that the forward direction flow and the reverse direction flow of the blow-by gas may be actively performed.

As illustrated in FIGS. 1 and 2, the oil filter system 10 for the vehicle according to various embodiments of the present invention includes a forward baffle plate 16, a reverse baffle plate 18, and a filter partition 40. Further, the oil filter system 10 is divided into four spaces, in which a crank case 22, a filter case 11, a blow-by case 24, and an oil pan 30 are mounted, by a shape of a cylinder block 20.

The forward baffle plate 16 is disposed between the crank case 22 and the filter case 11. Further, the forward baffle plate 16 may be integrally formed with the cylinder block 20. One will appreciate that such integral components may be monolithically formed. Further, the forward baffle plate 16 is formed in a plate shape including two surfaces such as two wide surfaces, and pores 17 passing through the two wide surfaces are formed in the forward baffle plate 16. Here, the pore 17 passing through the forward baffle plate 16 may be called the forward pore 17. The forward pore 17 allows the crank case 22 and the filter case 11 to communicate with each other.

The reverse baffle plate 18 is disposed between the blow-by case 24 and the filter case 11. Further, the reverse baffle plate 18 may be integrally formed with the cylinder block 20. One will appreciate that such integral components may be monolithically formed. Further, the reverse baffle plate 18 is formed in a plate shape including two surfaces such as two wide surfaces, and pores 19 passing through the two wide surfaces are formed in the reverse baffle plate 18. Here, the pore 19 passing through the reverse baffle plate 18 may be called the reverse pore 19. The reverse pore 19 allows the blow-by case 24 and the filter case 11 to communicate with each other.

The filter partition 40 is provided in the filter case 11. Further, the filter partition 40 is formed in a plate shape including two surfaces such as two wide surfaces. Further, the filter case 11 is divided into a first space 13 and a second space 15 by the filter partition 40. Further, the filter partition 40 is disposed so that one surface of the filter partition 40 faces one surface of the forward baffle plate 16, and the other surface of the filter partition 40 faces one surface of the reverse baffle plate 18. Here, the first space 13 is a space between the filter partition 40 and the forward baffle plate 16, and the second space 15 is a space between the filter partition 40 and the reverse baffle plate 18.

The filter partition 40 includes a filter pore 42 and a counterflow prevention hump 44, an example of which is illustrated in FIG. 3. The filter pore 42 includes a plurality of pores through which the blow-by gas passes. Further, the filter pore 42 may be formed in a substantially circular shape.

The counterflow prevention hump 44 protrudes along a circumference of at least one pore of the filter pore 42 or along a portion of a circumference of at least one pore of the filter pore 42. Further, the counterflow prevention hump 44 is formed in one surface and the other surface of the filter partition 40, and substantially perpendicularly protrudes from the one surface and the other surface of the filter partition 40. That is, the counterflow prevention hump 44 may have a substantially hollow cylindrical shape protruding along the circumference of the filter pore 42. Further, the blow-by gas selectively flows in a forward direction or a reverse direction by the pressure of the crank case 22, and the counterflow prevention hump 44 is formed to prevent the blow-by gas passing through the filter pores 42 according to the flow of the blow-by gas in the forward direction or the reverse direction from counter-flowing.

The oil pan 30 is mounted in the cylinder block 20 to be disposed at a lower side of the filter case 11. Further, an oil collection port 31 is formed at the cylinder block 20 and the oil pan 30 so that the inside of the oil pan 30 communicates with the filter case 11. That is, the oil collection port 31 is formed to pass through the cylinder block 20 forming a lower surface of the filter case 11 and an upper surface of the oil pan 30, which is in contact with the lower surface of the filter case 11. Further, the oil collection port 31 includes a forward collection port 33 formed so that the first space 13 of the filter case 11 communicates with the inside of the oil pan 30, and a reverse collection port 35 formed so that the second space 15 communicates with the inside of the oil pan 30. That is, at least two oil collection ports 31 may be formed.

In the meantime, the crank case 22 is a space in which a crank shaft of the engine is disposed, the cylinder block 20 is integrally formed or configured so that a plurality of cylinders and the crank case 22 are formed, and the oil pan 30 is a device installed at a lower side of the cylinder block 20 to store engine oil EO. One will appreciate that such integral components may be monolithically formed. The cylinder block 20, the crank case 22, and the oil pan 30 are known in the art, thus a more detailed description will be omitted.

The blow-by gas is gas discharged to the crank case 22 through a gap between the cylinder and the piston in a compression stroke and an expansion stroke of the engine. Further, the blow-by gas contains fine engine oil EO. The blow-by gas is known in the art, thus a more detailed description will be omitted.

The blow-by case 24 is a space formed to achieve smooth flow of the blow-by gas. Further, the blow-by case 24 communicates with a suction system. That is, a blow-by path 26 is formed in the cylinder block 20 so that the blow-by case 24 communicates with the suction system. Further, the blow-by gas moves between the blow-by case 24 and the suction system through the blow-by path 26. That is, the blow-by gas is supplied to the suction system to be recirculated to be combusted together with fuel-air mixture.

A check valve may be provided at the blow-by path 26 to prevent the blow-by gas from backwardly flowing from the suction system. However, the blow-by path 26 is not limited to the blow-by path 26 including the check valve, and may be variously modified and applied to adjust the pressure of the crank case 22 by a person of an ordinary skill in the art.

When the pressure of the crank case 22 is increased, the blow b gas generated in the crank case 22 moves to the suction system by sequentially passing through the filter case 11, the blow-by case 24, and the blow-by path 26. Further, when the pressure of the crank case 22 is decreased, the blow-by gas staying in the blow-by path 26 and the blow-by case 24 moves to the crank case 22 via the filter case 11. The flow of the blow-by gas is illustrated with an arrow in FIGS. 1 and 2.

Hereinafter, the forward direction flow of the blow-by gas will be described in detail with reference to FIG. 1. When the pressure of the crank case 22 is increased, the blow-by gas generated in the crank case 22 moves to the first space 13 of the filter case 11 through the forward pores 17 of the forward baffle plate 16. The blow-by gas moving to the first space 13 through the forward pores 17 is in contact with one surface of the filter partition 40. In this case, one surface of the filter partition 40 collects the engine oil EO contained in the contacted blow-by gas.

The blow-by gas from which the engine oil EO is extracted by the one surface of the filter partition 40 moves to the second space 15 of the filter case 11 through the filter pores 46. In this case, the counterflow of the blow-by gas to the first space 13 is prevented by the counterflow prevention hump 44 formed in the other surface of the filter partition 40.

The blow-by gas moving to the second space 15 is in contact with the reverse baffle plate 18. Further, the blow-by gas, which is in contact with the reverse baffle plate 18 moves to the blow-by case 24 through the reverse pores 19. The blow-by gas moving to the blow-by case 24 is supplied to the suction system through the blow-by path 26. That is, the blow-by gas is recirculated through the blow-by path 26.

In the meantime, the engine oil EO collected in the one surface of the filter partition 40 is dropped on the lower surface of the filter case 11 due to gravity or weight. Further, the engine oil EO dropped on the lower surface of the filter case 11 is collected at the oil pan 30 through the forward collection port 33 which communicates the first space 13 with the inside of the oil pan 30.

Hereinafter, the reverse direction flow of the blow-by gas will be described in detail with reference to FIG. 2. When the pressure of the crank case 22 is decreased, the blow-by gas staying in the blow-by path 26 and the blow-by case 24 moves to the second space 15 of the filter case 11 through the reverse pores 19 of the reverse baffle plate 18. The blow-by gas moving to the second space 15 through the reverse pores 19 is in contact with the other surface of the filter partition 40. In this case, the other surface of the filter partition 40 collects the engine oil EO contained in the contacted blow-by gas.

The blow-by gas from which the engine oil is extracted by the other surface of the filter partition 40 moves to the first space 13 of the filter case 11 through the filter pores 46. In this case, the counterflow of the blow-by gas to the second space 15 is prevented by the counterflow prevention hump 44 formed in the one surface of the filter partition 40.

The blow-by gas moving to the first space 13 is in contact with the forward baffle plate 16. Further, the blow-by gas, which is in contact with the forward baffle plate 16, moves to the crank case 22 through the forward pores 17.

When the pressure of the crank case 22 is increased again, the blow-by gas moving to the crank case 22 and the further generated blow-by gas flow in the forward direction. Further, the forward direction flow and the reverse direction flow of the blow-by gas may be repeated according to a change in the pressure of the crank case 22.

In the meantime, the engine oil EO collected at the other surface of the filter partition 40 is dropped on the lower surface of the filter case 11 by gravity or weight. Further, the engine oil EO dropped on the lower surface of the filter case 11 is collected at the oil pan 30 through the reverse collection port 35 through which the second space 15 communicates with the inside of the oil pan 30.

As described above, according to various embodiments of the present invention, the filter partition 40 collecting the engine oil EO is used in both of the forward direction flow and the reverse direction flow of the blow-by gas, so that it is possible to increase a quantity of engine oil collected at the oil pan 30. Accordingly, it is possible to decrease a quantity of consumption of the engine oil EO. Further, a quantity of engine oil EO contained in the fuel-air mixture is reduced, so that it is possible to improve performance of the engine.

For convenience in explanation and accurate definition in the appended claims, the terms "up" or "down", "inside" or "outside", and etc. are used to describe features of the exemplary embodiments with reference to the positions of such features as displayed in the figures.

The foregoing descriptions of specific exemplary embodiments of the present invention have been presented for purposes of illustration and description. They are not intended to be exhaustive or to limit the invention to the precise forms disclosed, and obviously many modifications and variations are possible in light of the above teachings. The exemplary embodiments were chosen and described in order to explain certain principles of the invention and their practical application, to thereby enable others skilled in the art to make and utilize various exemplary embodiments of the present invention, as well as various alternatives and modifications thereof. It is intended that the scope of the invention be defined by the Claims appended hereto and their equivalents.

What is claimed is:

1. An oil filter system for a vehicle, wherein the oil filter is provided at a cylinder block of an engine for collecting an engine oil from a blow-by gas generated in a crank case, the oil filter system comprising:

a blow-by path configured to recirculate the blow-by gas so that the blow-by gas generated in the crank case is combusted together with a fuel-air mixture;

a filter case that is a space formed between the crank case and the blow-by path;

a filter partition disposed to divide the filter case into two spaces, and configured to collect the engine oil contained in the blow-by gas;

an oil pan mounted in the cylinder block for collecting the engine oil that have been collected by the filter partition, wherein the filter partition is formed to collect the engine oil in a forward direction flow and a reverse direction flow of the blow-by gas, a forward baffle plate that spatially separates the crank case from the filter case; and a reverse baffle plate that spatially separates the filter case from the blow-by path, wherein the forward baffle plate and the reverse baffle plate are formed with pores through which the blow-by gas passes, and wherein the filter partition includes:

a filter pore comprising a plurality of pores through which the blow-by gas passes; and a counterflow prevention hump protruding along a circumference of the filter pore, wherein the blow-by gas passing through the pores of the forward baffle plate is in contact with one surface of the filter partition, the blow-by gas passing through the pores of the reverse baffle plate is in contact with the other surface of the filter partition, and the filter partition collects the engine oil when the blow-by gas is in contact with the filter partition.

2. The oil filter system of claim 1, wherein the engine oil collected at the filter partition is dropped by weight, and is collected at the oil pan through an oil collection port.

3. The oil filter system of claim 2, wherein the oil collection port includes a forward oil collection port facilitating collection of the engine oil that has been collected in the one surface of the filter partition, and a reverse oil collection port facilitating collection of the engine oil that has been collected in the other surface of the filter partition.

4. The oil filter system of claim 1, wherein the counterflow prevention hump is formed to prevent a counterflow of the blow-by gas passing through the filter pore when the blow-by gas is the forward direction flow and/or the reverse direction flow.

5. The oil filter system of claim 1, wherein the forward baffle plate and the reverse baffle plate are integrally formed with the cylinder block.

6. The oil filter system of claim 1, wherein the cylinder block is formed such that a space in which the oil pan is mounted, the crank case, the filter case, and the blow-by path are spatially separated from each other.

* * * * *